US007146771B2

(12) United States Patent
Swann

(10) Patent No.: US 7,146,771 B2
(45) Date of Patent: Dec. 12, 2006

(54) CAP SHEET, ROOFING INSTALLATION, AND METHOD

(75) Inventor: Raymond C. Swann, Kansas City, MO (US)

(73) Assignee: Johns Manville, Denver, CO (US)

( * ) Notice: Subject to any disclaimer, the term of this patent is extended or adjusted under 35 U.S.C. 154(b) by 557 days.

(21) Appl. No.: 10/378,855

(22) Filed: Mar. 4, 2003

(65) Prior Publication Data

US 2004/0172908 A1 Sep. 9, 2004

(51) Int. Cl.
*E04D 1/00* (2006.01)

(52) U.S. Cl. ..... 52/518; 52/409; 52/748.1; 52/746.11; 52/408

(58) Field of Classification Search ..... 52/409 X, 52/518 OR, 519, 748.1 X, 747.1, 746.11 X, 52/91.3, 408 X; 428/143, 150, 40.3, 57
See application file for complete search history.

(56) References Cited

U.S. PATENT DOCUMENTS 4,091,135 A * 5/1978 Tajima et al. ..... 428/40.3
5,766,729 A 6/1998 Zanchetta
5,843,522 A 12/1998 Zanchetta
6,134,856 A * 10/2000 Khan et al. ..... 52/536
6,145,580 A * 11/2000 Lamberti et al. ..... 164/418
6,360,506 B1 * 3/2002 Graae ..... 52/408
6,378,259 B1 * 4/2002 Carlson ..... 52/408
6,696,125 B1 * 2/2004 Zanchetta et al. ..... 428/40.1

* cited by examiner

*Primary Examiner*—Laurie K. Cranmer
(74) *Attorney, Agent, or Firm*—Robert D. Touslee

(57) ABSTRACT

A cap sheet for cold-applied adhesive roof installations includes a reinforcement mat saturated with and encapsulated within SBS modified bitumen. Bitumen layers above and beneath the mat have top and bottom major surfaces. The top surface of the top bituminous layer has a first edge portion extending inward from and along a first lateral edge. The bottom surface of the bottom bituminous layer has a second edge portion extending inward from and along a second lateral edge. The bitumen in the edge portions is a pressure-sensitive adhesive that is covered by release liners for protection prior to installation. When the cap sheets are installed, the release liners are removed from the edge portions and overlapping edge portions of the cap sheets are pressed and adhesively bonded together to immediately form effective watertight, weather-secure seams.

2 Claims, 2 Drawing Sheets

CAP SHEET, ROOFING INSTALLATION, AND METHOD

BACKGROUND OF THE INVENTION

The subject invention relates to a cap sheet for cold-applied adhesive roof installations, and, more specifically, to a cap sheet with lateral edge portions that form an immediate and effective bond with the lateral edge portions of other like cap sheets when the cap sheet is used in a cold-applied adhesive roof installation to provide a watertight and weather-secure seam. The subject invention also relates to a cold-applied adhesive roof installation utilizing the cap sheet of the subject invention and the method of making a cold-applied adhesive roof installation incorporating the cap sheet of the subject invention.

There is currently a long-standing problem associated with the utilization of cap sheets in cold-applied adhesive roof installations. In such installations the cap sheets are currently bonded to an underlying layer, typically a layer of base felts, with a cold-applied adhesive coating. When the cap sheets are adhesively bonded to the underlying layer of the roof installation with a cold-applied adhesive coating, the cold-applied adhesive coating must also be applied to overlapping lateral edge portions of the cap sheets for the purpose of bonding these overlapping edge portions of the cap sheets together. In addition to the need for a full width application of the cold-applied adhesive to the cap sheet at the job site in order to bond the overlapping edge portions of the cap sheets together, current cold-applied adhesives used for such applications take a period of time to set up and form a watertight and weather-secure seam with some such cold-applied adhesives curing to their ultimate bond strength only after days or weeks. Accordingly, many applicators are uncomfortable with the practice of bonding the overlapping lateral edges portions of these cap sheets together with such cold-applied adhesives. With the time it takes for these cold-applied adhesives to develop their ultimate bond strength, if a lap joint formed by the lateral edge portions of the cap sheets is subjected to wind and/or precipitation, the lap joint formed by the lateral overlapping edge portions of the cap sheets can fail adhesively and allow leakage of water under the seams of such lap joints. Thus, there has remained a need for forming cap sheet lap joints where the overlapping lateral edge portions of the cap sheets forming the lap joints are more quickly bonded together to form a watertight and weather-secure seam.

SUMMARY OF THE INVENTION

The cap sheet of the subject invention for cold-applied adhesive roof installations solves the long-standing problems associated with the use of cap sheets in cold-applied adhesive roof installations by providing the cap sheets with lateral edge portions that can be overlapped and more quickly bonded together to form watertight and weather-secure seams. The cap sheet of the subject invention includes a mat that is saturated with and encapsulated within SBS modified bitumen. The SBS modified bitumen forms top and bottom bituminous layers on the top and bottom sides of the mat and the top and bottom surfaces of these bituminous layers form the top and bottom major surfaces of the cap sheet. The top major surface of the cap sheet has a first lateral edge portion extending inward from and along a first lateral edge of the cap sheet. The bottom major surface of the cap sheet has a second lateral edge portion extending inward from and along a second lateral edge of the cap sheet.

The SBS modified bitumen in these lateral edge portions of the cap sheet is a pressure-sensitive adhesive which is covered by release liners to protect the pressure-sensitive adhesive from exposure during packaging, storage, shipment and handling. The release liners are peeled off at the job site immediately prior to the installation of the cap sheets. Other than its first lateral edge portion, the top major surface of the cap sheet is normally coated with an inorganic surfacing material such as roof granules. Other than its second lateral edge portion, the bottom major surface of the cap sheet is coated with a release material such as sand or some other inorganic surfacing material.

When the cap sheets of the subject invention are installed in a cold-applied adhesive roof installation, the cap sheets are adhered to base felts with a cold-applied adhesive. The release liners are peeled off the overlapping lateral edge portions of the cap sheets and the overlapping lateral edge portions of the cap sheets are pressed and immediately sealed together to form a watertight and weather-secure seal. Unlike current cold-applied adhesive roof installations, there is no need to wait for a cold-applied adhesive to cure to effectively bond the overlapping lateral edge portions of the cap sheets together and form a watertight and weather-secure seal. Furthermore, since the overlapping surfaces of the overlapping lateral edge portions of the cap sheets have a pressure-sensitive adhesive thereon, no adhesive is applied to these surfaces at the time of installation thereby reducing the amount of adhesive applied to the cap sheets in the field by about 10% when compared with current cold-applied adhesive installations.

DESCRIPTION OF THE PREFERRED EMBODIMENTS

Figure 1:
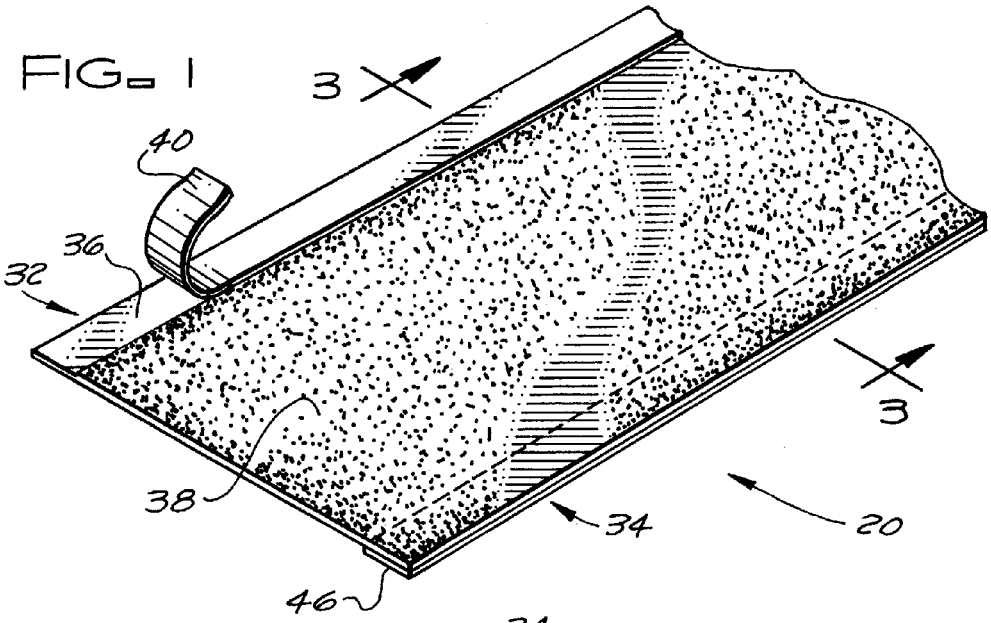
FIG. 1 is a partial schematic perspective view of the top major surface of a cap sheet of the subject invention.
Figure 2:
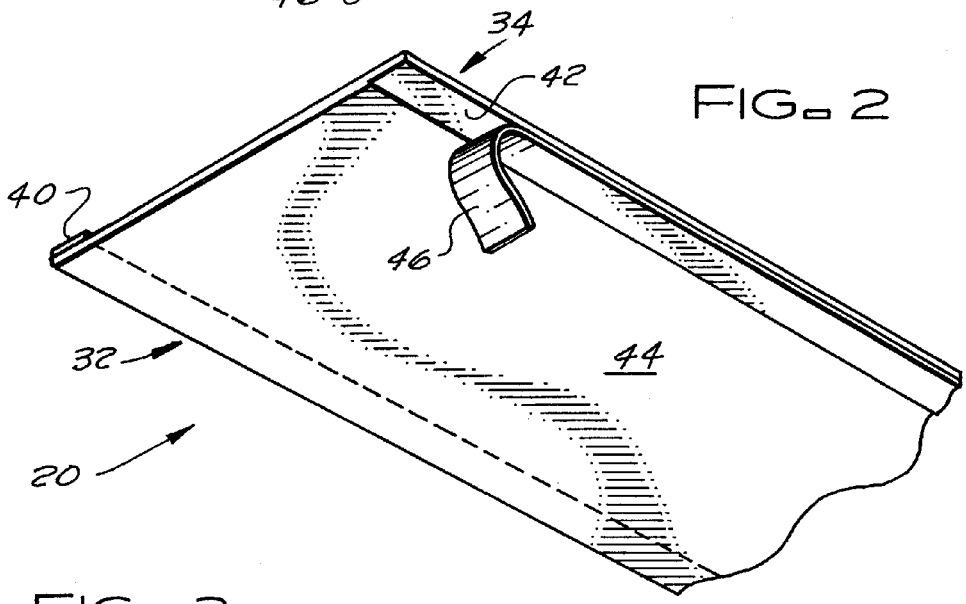
FIG. 2 is a partial schematic perspective view of the bottom major surface of the cap sheet of FIG. 1.
Figure 3:
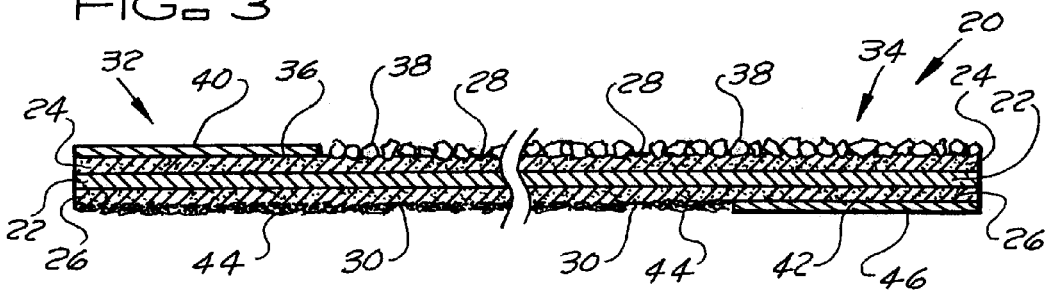
FIG. 3 is a transverse schematic cross section through the cap sheet of FIG. 1, taken substantially along lines 3—3 of FIG. 1, in a larger scale than FIG. 1, and with a midportion of the cap sheet broken away.

As shown in FIGS. 1 to 3, the cap sheet 20 of the subject invention for cold-applied adhesive roof installations has a reinforcement mat 22 that is saturated with a SBS rubber modified bitumen. The SBS rubber modified bitumen encapsulates the reinforcement mat 22 and forms a top layer 24 over and coextensive with the reinforcement mat 22 and a bottom layer 26 beneath and coextensive with the reinforcement mat 22. The top layer 24 of SBS rubber modified bitumen has a top major surface 28 and the bottom layer 26 of SBS rubber modified bitumen has a bottom major surface 30. The cap sheet 20 has a first longitudinally extending lateral edge 32 (commonly referred to as the selvage edge) and a second longitudinally extending lateral edge 34.

The top major surface 28 of the SBS rubber modified bitumen top layer 24 has a first lateral edge portion 36 extending inward from and along the first longitudinally extending lateral edge 32 of the cap sheet 20. A layer of inorganic surfacing material 38 is adhered to and, except for the first lateral edge portion 36 of the cap sheet 20, covers the top major surface 28 of the SBS rubber modified bitumen layer 24. The first lateral edge portion 36 of the top major surface 28 of the SBS rubber modified bitumen layer 24 is free of the inorganic surfacing material 38 with the SBS rubber modified bitumen in the first lateral edge portion 36 of the cap sheet 20 functioning as a pressure-sensitive adhesive to bond the lateral edge portions of the cap sheets 20 together upon installation of the cap sheets 20 in a cold-applied adhesive roof installation to immediately form an effective watertight and weather-secure seam between the cap sheets. The SBS rubber modified bitumen in the first lateral edge portion 36 of the top major surface 28 is overlaid by a first release liner 40.

The bottom major surface 30 of the SBS rubber modified bitumen bottom layer 26 has a second lateral edge portion 42 extending inward from and along the second longitudinally extending lateral edge 34 of the cap sheet 20. A layer of release material 44 is adhered to and, except for the lateral edge portion 42, covers the bottom major surface 30 of the SBS rubber modified bitumen layer 26. The second lateral edge portion 42 of the bottom major surface 30 of the SBS rubber modified bitumen layer 26 is free of the release material 44 with the SBS rubber modified bitumen in the second lateral edge portion 42 of the cap sheet 20 functioning as a pressure-sensitive adhesive to bond the lateral edge portions of the cap sheets 20 together upon installation of the cap sheets 20 in a cold-applied adhesive roof installation to immediately form an effective watertight and weather-secure seam between the cap sheets. A second release liner 46 overlies the SBS rubber modified bitumen in the second lateral edge portion 42 of the cap sheet 20. When the cap sheets 20 are installed in a cold-applied adhesive roof installation, the release liners 40 and 46 are peeled from the lateral edge portions 36 and 42 of the cap sheets 20; the lateral edge portions 36 and 42 of successive cap sheets 20 are overlapped; and the overlapping lateral edge portions 36 and 42 of the successive cap sheets 20 are pressed and bonded together to immediately form an effective watertight and weather-secure seam between the cap sheets.

The reinforcement mat is a non-woven synthetic fiber mat such as a glass fiber or polyester mat, and preferably a 170 to 180-g/$m^2$ non-woven polyester mat such as that sold by Johns Manville International, Inc. under the trade designation Duragrid™ 055/170 polyester mat.

Preferably, the SBS (Styrene-Butadiene-Styrene) rubber modified bitumen has the following composition:

| INGREDIENT | PERCENTAGE BY WEIGHT |
|---|---|
| 70-200 Penetration Bitumen | 50–70 |
| Radial SBS Polymer | 3.0–18 |
| Diblock SB Polymer | 3.0–18 |
| Hydrocarbon Resin, $C_5$–$C_9$ | 2.0–12 |
| Nepthenic Process Oil | 2.0–12 |
| Antioxidant | 0–0.2 |

An example of a 70–200-penetration bitumen that may be used in the composition is a 70–200-penetration bitumen sold by ConocoPhillips (Wood River) under the trade designation PG 58-22. An example of a radial SBS polymer that may be used in the composition is radial SBS polymer sold by Polimier Europa under the trade designation 161B. An example of a diblock SB polymer that may be used in the composition is a diblock SB polymer sold by Polimier Europa under the trade designation 6320. An example of a hydrocarbon resin, $C_5$–$C_9$, sold by Escorez under the trade designation 2101. An example of an antioxidant that may be used in the composition is an antioxidant sold by Ciba-Geigy Ivgonox under the trade designation 1010.

Preferably, the inorganic surfacing materials forming the layer of inorganic surfacing materials 38 on the top major surface 26 of the cap sheet 20 are roofing granules, e.g. ceramic-coated granite. Preferably, the release materials forming the release layer 44 on the bottom major surface 30 of the cap sheet 20 are inorganic surfacing materials such as sand. The release liners 40 and 46 may be strips of a sheet or film material that have their surfaces that are in contact with the SBS rubber modified bitumen in the edge portions 36 and 42 of the cap sheet coated with a conventional release agent. For example, the release liners can be strips of polymeric film coated with a silicon release agent.

The cap sheet 20 is typically between about 36 and about 40 inches in width, preferably about 40 inches in width, and is typically sold in 1 square (108 square foot) rolls. The lateral edge portions 36 and 42 of the cap sheets 20 are typically between about 2 and about 4 inches in width, preferably about 4 inches in width, and when installed, successive cap sheets 20 are normally overlapped the full width of the lateral edge portions.

Figure 4:
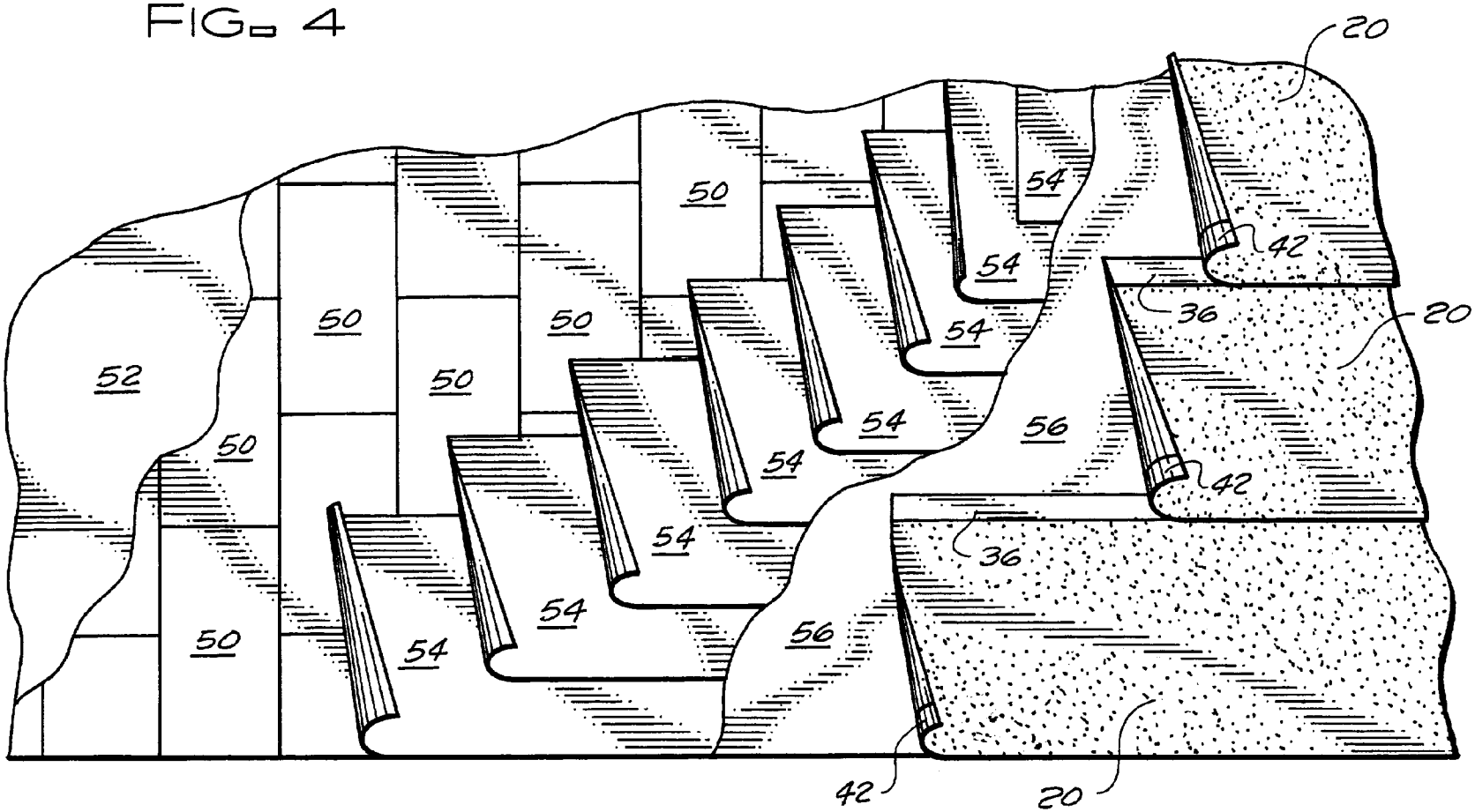
FIG. 4 is a partial schematic view from above of a typical cold-applied adhesive roof installation incorporating the cap sheet of the subject invention with pieces of a roof insulation board layer removed to show part of the roof deck, portions of a base felt layer peeled back to show part of the roof insulation board layer, and portions of the cap sheet layer peeled back to show part of the base felt layer.

As shown in FIG. 4, a typical cold-applied adhesive roof installation incorporating the cap sheets 20 may include roof insulation boards 50, such as but not limited to high density, low thermal, rigid insulation boards composed primarily of expanded perlite with reinforcing cellulosic fibers and selected binders. An example of such an insulation board is an insulation board sold by Johns Manville International, Inc. under the trade designation DuraBoard™ insulation board. The insulation boards 50 are secured to the roof deck 52 and a layer of light weight, asphalt coated, base felts 54, e.g. fiber glass base felts, overlie and are secured by a cold-applied modified asphalt, roof ply adhesive to the insulation boards. An example of such a base felt is a base felt sold by Johns Manville International, Inc. under the trade designation PermaPly® 28 base felt. The cap sheets 20 overlie and are adhesively secured to the layer of base felts by a cold-applied modified asphalt, roof ply adhesive layer 56. An example of a such a cold applied modified asphalt, roof ply adhesive is an adhesive sold by Johns Manville International, Inc. under the trade designation MBR® quick set adhesive. When the cap sheets 20 are applied over the layer of base felts 54, the overlapping lateral edge portions 36 and 42 of the cap sheets 20 are pressed and bonded together to form an effective watertight, weather-secure seam. There is no need to wait for a cold-applied adhesive on the lateral edge portions of cap sheets to develop its ultimate bond strength and seal the overlapping edge portions of the cap sheets as in previous traditional cold-applied adhesive installations.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A cap sheet for cold-applied adhesive roof installations, comprising:

a reinforcement mat saturated with and encapsulated within a SBS rubber modified bitumen; the mat being a 170 to 180 g/m$^2$ non-woven polyester mat; the SBS rubber modified bitumen comprising:

| INGREDIENT | PERCENTAGE BY WEIGHT |
|---|---|
| 70-200 Penetration Bitumen | 50–70 |
| Radial SBS Polymer | 3.0–18 |
| Diblock SB Polymer | 3.0–18 |
| Hydrocarbon Resin, $C_5$–$C_9$ | 2.0–12 |
| Nepthenuc Process Oil | 2.0–12 |
| Antioxidant | 0.0–0.2 |

the SBS rubber modified bitumen forming a top layer above the mat and a bottom layer beneath the mat; the top SBS rubber modified bitumen layer having a top major surface and the bottom SBS rubber modified bitumen layer having a bottom major surface; the SBS rubber modified bitumen saturated and encapsulated reinforcement mat having a first longitudinally extending lateral edge and a second longitudinally extending lateral edge;

the top major surface of the top SBS rubber modified bitumen layer having a first lateral edge portion extending inward from and along the first longitudinally extending lateral edge; a layer of inorganic surfacing material granules adhered to the top major surface of the top SBS rubber modified bitumen layer; the first lateral edge portion of the top major surface of the top SBS rubber modified bitumen layer being free of the inorganic surfacing material; the SBS rubber modified bitumen in the first lateral edge portion being a pressure-sensitive adhesive; the SBS rubber modified bitumen in the first lateral edge portion being overlaid by a first release liner;

the bottom major surface of the bottom SBS rubber modified bitumen layer having a second lateral edge portion extending inward from and along the second longitudinally extending lateral edge; a layer of release material adhered to the bottom major surface of the bottom SBS rubber modified bitumen layer; the second lateral edge portion of the bottom major surface of the bottom SBS rubber modified bitumen layer being free of the release material; the SBS rubber modified bitumen in the second lateral edge portion being a pressure-sensitive adhesive; the SBS rubber modified bitumen in the second lateral edge portion being overlaid by a second release liner whereby, when installed, a removal of the release liners on overlapping edge portions of cap sheets permits the overlapping lateral edge portions of the cap sheets to be pressed and bonded together to immediately form an effective watertight, weather-secure seam; and the SBS rubber modified bitumen saturated and encapsulated mat being between about 36 and about 40 inches in width and first and second edge portions are each between about 2 inches and about 4 inches in width.

2. A cold-applied adhesive roof installation, comprising:

base felts overlaying a roof deck;

cap sheets overlaying and adhered to the base felts by a cold application adhesive; each cap sheet being a reinforcement mat saturated with and encapsulated within a SBS rubber modified bitumen; the mat being a 170 to 180 g/m$^2$ non-woven polyester mat; the SBS rubber modified bitumen comprising:

| INGREDIENT | PERCENTAGE BY WEIGHT |
|---|---|
| 70-200 Penetration Bitumen | 50–70 |
| Radial SBS Polymer | 3.0–18 |
| Diblock SB Polymer | 3.0–18 |
| Hydrocarbon Resin, $C_5$–$C_9$ | 2.0–12 |
| Nepthenuc Process Oil | 2.0–12 |
| Antioxidant | 0.0–0.2 |

the SBS rubber modified bitumen forming a top layer above the mat and a bottom layer beneath the mat; the top SBS rubber modified bitumen layer having a top major surface and the bottom SBS rubber modified bitumen layer having a bottom major surface; the SBS rubber modified bitumen saturated and encapsulated reinforcement mat having a first longitudinally extending lateral edge and a second longitudinally extending lateral edge; the top major surface of the top SBS rubber modified bitumen layer having a first lateral edge portion extending inward from and along the first longitudinally extending lateral edge; a layer of inorganic surfacing material granules adhered to the top major surface of the top SBS rubber modified bitumen layer; the first lateral edge portion of the top major surface of the top SBS rubber modified bitumen layer being free of the inorganic surfacing material; the SBS rubber modified bitumen in the first lateral edge portion being a pressure-sensitive adhesive; and the bottom major surface of the bottom SBS rubber modified bitumen layer having a second lateral edge portion extending inward from and along the second longitudinally extending lateral edge; a layer of release material adhered to the bottom major surface of the bottom SBS rubber modified bitumen layer; the second lateral edge portion of the bottom major surface of the bottom SBS rubber modified bitumen layer being free of the release material; the SBS rubber modified bitumen in the second lateral edge portion being a pressure-sensitive adhesive; the cap sheets each being between about 36 and about 40 inches in width and first and second edge portions are each between about 2 inches and about 4 inches in width;

the second edge portions of the cap sheets overlapping the first lateral edge portions of the cap sheets and being adhesively bonded to the first lateral edge portions of the cap sheets by the SBS rubber modified bitumen in the first and second lateral edge portions of the cap sheets which have been pressed together to form water-tight, weather-secure seams; and a layer of roof insulation lying between the base felts and the roof deck.

* * * * *